United States Patent [19]

Koenig

[11] 4,098,652

[45] Jul. 4, 1978

[54] METHOD OF ELECTROFORMING

[75] Inventor: Myron Koenig, Mamaroneck, N.Y.

[73] Assignee: M. Argueso & Co., Inc., Mamaroneck, N.Y.

[21] Appl. No.: 766,673

[22] Filed: Feb. 8, 1977

[51] Int. Cl.[2] ..... C25D 1/00; C25D 1/10

[52] U.S. Cl. ..... 204/4; 204/281

[58] Field of Search ..... 204/3, 4, 9, 281

[56] References Cited

PUBLICATIONS

Product Engineering, Jun. 5, 1961, pp. 609–614.

Industrial Finishing & Surface Coatings, vol. 25, No. 299, May 1973, pp. 14, 16, 18, 20.

*Primary Examiner*—T. M. Tufariello

*Attorney, Agent, or Firm*—Parmelee, Johnson, Bollinger & Bramblett

[57] ABSTRACT

A method for electroforming and electrodischarge machining uses, an electrically conductive thermoplastic wax composition which can act as an electrode on which a metal article may be electroformed and as an electrode mount for the metal article to be electrodischarge machined. The electrically conductive thermoplastic wax composition comprises a thermoplastic wax material and very small spherical particles the surface of which have been treated to make them electrically conductive. The electrically conductive thermoplastic wax composition is easily separated from the metal articles formed by electroforming or electrodischarge machining (EDM) by heating to melting temperature and/or by use of a suitable solvent for the thermoplastic wax. In this way, the composition may readily be recovered for repeated reuse in another electroforming or EDM process, and accurately formed finished articles having intricate shapes and close tolerances can be produced. In a preferred embodiment, the spherical particles are silver coated solid glass microspheres comprising 60 to 75 percent, by weight, of the overall thermoplastic wax composition.

10 Claims, No Drawings

METHOD OF ELECTROFORMING

BACKGROUND OF THE INVENTION

This invention relates to the field of manufacturing and shaping articles by electroforming and machining procedures utilizing electrode reactions. More specifically, this invention is directed to a method of preparing articles by electroforming, and electrodischarge machining and a composition for use therein.

Electroforming is becoming increasingly popular as a method of producing hollow metal parts that have accurate contours and dimensions. This is done by providing an electrically conductive substrate or mandrel that has the contours, dimensions and surface finish desired for making the finished hollow article. The mandrel is then made the cathode of an electro-forming circuit and the desired amount of metal is plated onto it to form a metal wall of sufficient thickness to be self-supporting. The mandrel and the article must then be separated from one another, a requirement which often imposes design restrictions limiting the production of complex shapes having undercut portions and reentrant sections.

In electroforming the electrolyte solution in which the electrically conductive cathode of predetermined pattern is immersed contains dissolved salts of the metal to be deposited and the anode is a suspended slab of the metal to be deposited. A relatively high current flow per unit area of the cathode takes place for rapidly and accurately building up a thick metal wall around the cathode of sufficient thickness to provide a self-supporting wall for the resultant hollow article.

In electrodischarge machining, metal is removed accurately in a predetermined pattern from an article which may be of intricate configuration through the action of a high energy electric discharge on the region of the conductive work piece where the predetermined pattern of metal is to be removed. A thin gap is maintained between the electrode probe tool and the work piece which serves as the other electrode, both of which are submerged in a fluid which is a very poor conductor of electricity, for example, a light oil. The work piece requires a low impedance electrical connection thereto for accommodating the desired relatively high current flow, and when the voltage across the gap becomes sufficiently high it discharges through the gap in the form of a spark at frequent intervals. Each discharge removes material from both the tool and the work piece which serve as the circuit electrodes. Through various modifications of electrodischarge machining intricate shapes and contours can be cut. In all cases, however, the material which is to be machined must be a fairly good electrical conductor and must have a low impedance electrical connection thereto, regardless of size or intricacy of configuration.

Metallic powders added as filler to thermosetting plastic materials can produce electrically conductive materials. Thermosetting plastics have had glass spheres added thereto as a bulking agent and can be electrically conductive when the spheres possess electrically conductive surfaces.

In order for any material to serve as the mandrel in an electroforming operation, it must be electrically conductive. Presently, electroforming and electrodischarge machining (EDM) is carried out using low melting point temperature metal alloys containing bismuth, lead and/or antimony, for example such as is commercially available under the trade designation "Cerro-Alloy"

from Cerro Corporation. Such metal alloys have a melting point range of approximately 90° to 150° C. Those alloys in the low part of this range may be separated from the electroformed metal part using boiling water. However, in many cases, particularly where complicated configurations are involved, traces of those alloys containing bismuth, lead and/or antimony have been known to remain in cavities in the formed part, so that articles for which it is desired to obtain close internal tolerances may not achieve the desired tolerances when using this method. In some cases, a particle or small chunk of the alloy may remain lodged in a narrow cavity in a part of intricate shape. Where such metal part is intended to be operated in a critical high-temperature environment, such as in the aircraft industry, a further problem can arise. The low melting temperature alloy which is present can become alloyed during high temperature operation with the metal part itself, thereby changing the local contour and/or chemistry of the part, possibly rendering it defective.

In EDM where the low melting temperature alloy may be used to provide a low impedance electrical connection to a work piece of intricate shape which forms one of the electrodes, toxic fumes of lead, bismuth and/or antimony may suddenly become released into the atmosphere if the spark discharging from the electrode probe tool punctures through the work piece and strikes this alloy. Moreover, such alloys are rather heavy (weighing generally five to six times as much as the silver-coated glass sphere containing wax compositions disclosed herein) and are expensive to use.

Thus, it can be seen that there have been both advantages and disadvantages to methods of forming, using electrically conductive work pieces. For example, when finely divided metal powders, such as silver, copper, or zinc, are added to a thermosetting plastic, such as epoxy in order to make it conductive, the conductive resin becomes costly due to the expenses of the powder plus resin, and becomes heavy because of the density of the metal added. The thermosetting conductive plastics present a most difficult cleaning problem and can only be used once, thereby further augmenting the expenses of use. In some cases, the thermosetting conductive plastics are laboriously removed from electroformed articles by a vapor solvent exposure process which consumes many hours for completion, causing very slow, expensive production. In electroforming, one either has to limit the shape of the article produced to that which will permit the mandrel to be removed if higher speed production is desired, or use the low melting point metal alloy containing bismuth, lead and/or antimony. Such alloys, although separable, cannot be completely removed from the electroformed article, so that parts with critically close tolerances are difficult to manufacture by this method or may become defective by inadvertent subsequent thermal alloying effects in higher temperature environments.

Nevertheless, the relatively high current flow electrode reaction electroforming and EDM processes described above are increasing in popularity because of the advantages over conventional machine-tool forming processes for certain applications, such as for intricate shaped hollow metal articles and for those having apertures or recesses of complex configurations. Electroforming is a particularly fast growing industry because it enables the fabrication of complex parts with the reduction of conventional machining requirements. Thus, the need for different and improved electroforming and electrodischarge machining processes remains. It would be especially advantagesous if these processes could be reduced in cost.

SUMMARY OF THE INVENTION

The present invention overcomes some of the drawbacks in the existing forming processes described above through the provision of a method for electroforming and electrodischarge machining using an electrically conductive thermoplastic wax composition which can act as an electrode. The electrically conductive thermoplastic wax composition is both economical and easy to use and, most importantly, can be reused in electroforming and EDM where it does not form a part of the final article.

The foregoing is accomplished, according to this invention, by selecting a thermoplastic wax material and incorporating therein spherical particles the surfaces of which have been treated or coated to make them electrically conductive. The treated coated spheres are added in an amount sufficient to make the thermoplastic wax material electrically conductive but insufficient to adversely affect the ability of the thermoplastic wax material to properly flow when in the fluid state to achieve the desired configuration. Advantageously, the thermoplastic wax material may be similar to those suitable for use in investment casting procedures, so as to retain a molded shape or form at ambient temperatures. The glass spheres are solid glass microspheres all smaller than size 325 mesh, i.e. 44 microns in diameter or less, and coated with at least 4 percent silver by weight. The electrically conductive wax composition advantageously contains 60 to 75 percent, by weight, of the silver-coated glass microspheres.

The spherical particles contribute to the flow properties of the composition while at the same time imparting isotropic properties enabling effective shaping of designs and patterns on which it is desired to deposit the metal. Due to their spherical shape, the microspheres provide reliable contact between one another when packed rather densely together, so as to provide multiple electrically conductive paths in the thermoplastic wax material. The packing characteristics of spheres are such that voids will always exist between spheres of a generally similar size, so that good contact with low bulk density is achieved resulting in a light weight conductive composition. Moreover, the density of glass spheres, even when coated with silver, is less than that of other conductive particulates such as metal powders.

Although the silver-coated glass microspheres are advantageous, it is to be understood that other compartively low density spheroidal materials having electrically conductive surfaces and which will predictably contact one another and impart isotropic properties when incorporated in the thermoplastic wax material to make the wax electrically conductive are suitable for use in this invention. Similarly, while generally any thermoplastic wax material may be utilized in this invention, it must nevertheless be a wax material which will permit the surface-conductive particles to achieve the necessary contact with one another to provide the requisite conductivity. Thus, an atypical thermoplastic wax composition in which the presence of insoluble impurities or unusual properties prevent effective contact of the spherical particles to provide electrically conductive paths are desirably excluded from use herein.

When it is desired to separate the electrically conductive thermoplastic wax composition from the electroformed article which has been deposited thereon, the composition, according to this invention, may be readily removed by heating above the melting point of the wax and allowing it to flow out of the resultant article. In all cases, a suitable solvent for the wax is used for removal of any residuals following melt out. The wax may be a water soluble wax in which event hot water can be used as the solvent. In most cases, the wax is one which is susceptible to dissolution by organic solvents, such as hot perchlorethylene. With the electrically conductive thermoplastic wax composition of this invention, all traces of wax are removed and the electro-deposition forming of critically close tolerances is possible. The major portion of the thermoplastic conductive wax is recovered by the above melt-out step. This recovered wax may then be reused in forming a mandrel for another electroforming process.

To electroform, according to this invention, the electrically conductive thermoplastic wax composition is heated to a fluid state, usually at a temperature above that at which the wax material without the presence of the electrically conductive spherical particles would be molded, and poured or injection molded to produce the desired molded wax pattern for electroforming metal deposition. The electrically conductive thermoplastic wax pattern is then used as the cathode in an electroforming circuit and a metal article deposited thereon. The conductive wax composition is removed from the hollow electroformed article and recovered, as described above.

To EDM according to this invention the electrically conductive thermoplastic wax composition serves to provide a low impedance electrial connection to a work piece of intricate shape which forms one of the electrodes. This conductive wax composition is flowed into position and sets around the work piece which is thereby held at the desired attitude on a conductive support to which the work piece is electrically joined by the solidified conductive wax. Following the desired electric discharge matchining of the work piece, the major portion of the solidified wax is recovered by melting it away from the work piece. Then, a suitable solvent is used to remove the residual conductive wax composition from the work piece.

Thus, a feature of this invention is the provision of a method for electroforming and/or electrodischarge machining of articles using an electrically conductive thermoplastic wax composition.

A further feature of this invention is the provision of an electrically conductive thermoplastic wax composition having incorporated therein low density spherical particulate material the surface of which is electrically conductive.

Yet another feature of this invention is the provision of a method for producing articles by electroforming and/or electrodischarge machining in which the electrode material is an electrically conductive thermoplastic wax composition which may be separated from the formed metal part with comparative ease and completeness and recovered for reuse in the same method.

A further feature of this invention is the provision of an article which has been formed by electroforming and/or electrodischarge machining using an electrically conductive thermoplastic wax material as the electrode work piece.

The foregoing and other features, advantages and objects of this invention will become further apparent from the following description of preferred embodiments of the same.

DESCRIPTION OF THE PREFERRED EMBODIMENTS

The following examples best illustrate preferred embodiments of this invention.

EXAMPLE 1

Various amounts of silver-coated glass microspheres were incorporated into a thermoplastic wax material, the samples molded into cylinders, the resistance measured and the conductivity observed. The specific composition of the thermoplastic wax material used in this example was as follows:

| Material | Weight Percent |
|---|---|
| Chlorinated terphenyl resin containing 60% chlorine by weight | 75.23 |
| T-57-N | 8.20 |
| Carnauba Wax | 12.15 |
| Elvax 250 | 4.42 |

"T-57-N" is a hydrofol glyceride commercially available from Ashland Chemical Company, New Jersey, while "Elvax 250" is an ethylene vinyl acetate resin available from E. I. DuPont de Nemours & Co., Wilmington, Delaware. Carnauba is a well known vegetable wax. The above wax composition has a ball and ring softening point of approximately 170° to 180° F.

Using the thermoplastic wax material set forth above, samples were prepared containing various amounts of silver-coated solid glass microspheres smaller than 325 mesh and containing a coating of 4 percent silver, by weight. These glass spheres are commercially available under the designation "S-3000-S" from Potters Industries, Inc., Atlantic Division, Carlstadt, New Jersey. The samples were molded into cylinders two inches long and 0.6 inches in diameter and the resistance of each cylinder measured using a Simpson Model 260 ohmmeter. In addition, in order to determine whether the composition of thermoplastic wax material and silver coated glass spheres was electrically conductive, a simple measurement using the cylinder as part of an electrical circuit containing a 100 watt light bulb was made. If the light bulb lit, the composition was determined to be electrically conductive at an acceptable level.

The results are set forth in Table 1 below showing the sample compositions and the resistance measurements and electrical conductivity observance.

TABLE 1

| Sample No. | Wax Weight % | Glass Spheres Weight % | Resistance Ohms | Electrically Conductive |
|---|---|---|---|---|
| 1 | 50 | 50 | too high to measure | No |
| 2 | 45 | 55 | 105,000 | No |
| 5 | 42.5 | 57.5 | 200 | Yes |
| 3 | 40 | 60 | 8.75 | Yes |
| 4 | 35 | 65 | 0.55 | Yes |

The results show that a thermoplastic wax composition can be made electrically conductive through the addition of silver coated glass spheres thereto and that there is a certain minimum amount of glass spheres which must be added before satisfactory conductivity is achieved.

EXAMPLE 2

The effect of silver coated glass spheres on the resistance of a wide variety of thermoplastic waxes, both blends and base waxes, was measured. The results, set forth in Table 2, demonstrate that essentially any thermoplastic wax can have its resistance lowered and can be made electrically conductive by incorporating therein silver coated glass spheres in proportions which vary from wax to wax depending on certain predictable or readily observable wax properties. In most instances, 65 percent, by weight, glass spheres provides the level at which the wax becomes most conductive.

It was observed that there is a slight correlation between both the density and viscosity at pouring temperatures of a wax and the manner in which it will conduct electricity with a coated glass sphere content in the range of 60–70 percent. Thus, with low density waxes the glass spheres may have a tendency to settle with a result that uniform distribution is not obtained. Also, if at the pouring temperature, the wax is especially viscous it will better hold the spheres in suspension so that uniform distribution of glass spheres will be maintained and good conductivity obtained. However, if such a wax is heated to a temperature at which the viscosity decreases the spheres may settle and separate. The extent to which separation occured was observed. Those skilled in the art will be able to determine from the known and observable properties of the thermoplastic wax material used and from the conductivity measurements the proper amount of silver coated glass spheres to be added thereto to obtain a desired conductivity while maintaining uniformity and desired pour characteristics for molding.

The various types of waxes used are as follows. Carnauba and candelilla wax are both commonly known vegetable waxes while beeswax is an insect wax which is also well-known. "Sun 4412" is a paraffin wax having a melting point, as measured by ASTM D 87 (American Melt Point Method) of 145° F. and commercially available from Sun Oil Company, Industrial Products Department, Philadelphia, Pennsylvania. "Be Square 195 Amber" is a microcyrstalline wax having a melting point in the range of 193–198 ° F. and is commercially available from Petrolite Corporation, Bareco Division, Tulsa, Oklahoma. Montan is a commonly known wax prepared from lignite. "Cerita 956" is a commercially available water soluble wax prepared from a mixture of polyethylene glycols, made by M. Argueso & Co., Inc. of Mamaroneck, New York.

The thermoplastic wax compositions using waxes in Blend A and in Blend B are as follows:

| Blend A | |
|---|---|
| Material | Weight Percent |
| Candilla wax | 25 |
| Terpene Phenol resin | 25 |
| Hydrogenated glyceride | 24 |
| Microcrystalline wax | 26 |

| Blend B | |
|---|---|
| Material | Weight Percent |
| Chlorinated Terphenyl resin containing 60% chlorine by weight | 50 |
| Microcrystalline wax | 20 |
| Paraffin wax | 20 |
| Carnauba wax | 10 |

The coated glass spheres were the "S-3000-S" described previously. Resistance measurements were made by placing electric probes in cast blocks of the thermoplastic wax plus coated glass sphere composition. The blocks were prepared by pouring the composition into a p an and permitting it to set. The block size was approximately 4 inches by 5 inches by 3 inches thick vertically.

TABLE 2

| Sample No. | Wax Type | Wax Weight % | Glass Spheres Weight % | Resistance Ohms |
|---|---|---|---|---|
| 1 | Carnauba | 50 | 50 | too high to measure |
| 2 | " | 40 | 60 | 200 |
| 3 | " | 35 | 65 | 7 |
| 4 | Candelilla | 50 | 50 | too high |
| 5 | " | 40 | 60 | 15 |
| 6 | " | 35 | 65 | 8 |
| 7 | Beeswax | 50 | 50 | 0.6 |
| 8 | " | 40 | 60 | 0.3 |
| 9 | " | 35 | 65 | 0.4 |
| 10 | Sun 4412 | 50 | 50 | 1.0 |
| 11 | " | 40 | 60 | 0.7 |
| 12 | " | 35 | 65 | 0.3 |
| 12A | " | 30 | 70 | 50 |
| 13 | Be Square 195 | 50 | 50 | too high |
| 14 | " | 40 | 60 | 5.5 |
| 15 | " | 35 | 65 | 0.8 |
| 16 | Montan | 50 | 50 | too high |
| 17 | " | 40 | 60 | too high |
| 18 | " | 35 | 65 | 300 |
| 19 | Cerita 956 | 50 | 50 | 1.8 |
| 20 | " | 40 | 60 | 0.2 |
| 21 | " | 35 | 65 | 0.1 |
| 22 | Blend A | 50 | 50 | too high |
| 23 | " | 40 | 60 | 9.5 |
| 24 | " | 35 | 65 | 4 |
| 25 | Blend B | 50 | 50 | 7 |
| 26 | " | 40 | 60 | 0.8 |
| 27 | " | 35 | 65 | 0.3 |

Sample Nos. 7 through 9 using the beeswax and 10 through 12 using the "Sun 4412", showed a heavy separation of coated glass spheres and wax so that the values there should be considered to be those in the wax layer containing the glass spheres which would then have a somewhat higher concentration of glass spheres than the weight percent shown. That is, in those situations where heavy separation occured, there was, for example, a 1 to 1 ½ inches lower layer containing the spheres with a 1 ½ to 2 inches layer of wax above it. The resistance measurements were made, in those instances referred to above, by sticking probes in the ends of the layer portion containing the glass spheres. In many instances, the separation can be overcome by pouring or injecting the composition for molding at as low a temperature as possible, the lowest temperature at which the material is flowable, so as to retain an essentially uniform mix.

In Sample Nos. 13 through 15, with the "Be Square Amber 195", and 19 through 21 using the "Cerita 956", a very slight film of wax on the surface, suggesting some separation, was observed. A thin layer of wax on the surface was also observed in Sample Nos. 22 through 27 with the Blend A and the Blend B. However, in Sample No. 12A, the very viscous nature of the mixture containing 70% microspheres kept the separation to a minimum.

The results show that essentially any thermoplastic wax can be made electrically conductive according to this invention by incorporating therein the silver coated glass spheres in a range of essentially 60 to 75 percent, by weight. With respect to the samples utilizing Montan wax, it is believed that another phenomenon contributed to the high resistance measurements, namely the presence of insoluble impurities which keep the coated glass spheres from contacting one another to provide conductive paths.

In order to determine the effectiveness of the electrically conductive thermoplastic wax composition in electro-forming methods, several compositions were prepared and subjected to experimental field trials in electrodeposition processes. The thermoplastic wax was made electrically conductive by incorporating therein silver coated glass microspheres of the type described previously with regard to the foregoing examples. The electrically conductive thermoplastic wax composition was molded into an electrode at a temperature which permitted it to flow while maintaining uniformity of the composition. Where a wax is normally poured or injection molded at a given temperature, for example 250° F, the presence of glass microspheres, in amounts such as 70 percent, by weight, requires the use of slightly higher temperatures, for example, 275° to 300° F. The molded electrically conductive thermoplastic wax was then placed in an electrodeposition bath and the metal deposition effect observed. The results are described below with respect to EXAMPLES 3 through 6.

EXAMPLE 3

An electrically conductive wax having the composition set forth below showed a measured resistance of less than 0.1 ohms. Although the electrically conductive wax was highly viscous, it worked well in actual field experimental use.

| Material | Weight Percent |
|---|---|
| Chlorinated terphenyl resin containing 60% chlorine by weight | 23.61 |
| T-57-N | 2.58 |
| Carnauba Wax | 3.81 |
| Glass Spheres, S-3000-S | 70.00 |

EXAMPLE 4

A composition of electrically conductive thermoplastic wax similar to that of EXAMPLE 3 was prepared containing a lesser amount of coated glass spheres. The resistance was measured as 1.5 ohms and although the composition was still highly viscous in the pourable state, it worked successfully in actual field experimental use in electrodeposition. The composition used is as follows:

| Material | Weight Percent |
|---|---|
| Chlorinated terphenyl resin containing 60% chlorine by weight | 27.55 |
| T-57-N | 3.00 |
| Carnauba Wax | 4.45 |
| Glass Spheres, S-3000-S | 65.00 |

EXAMPLE 5

An electrically conductive thermoplastic wax composition using a wax was prepared with 65 weight percent coated glass spheres. The measured resistance of 4 to 10 ohms was somewhat higher than that of the wax of EXAMPLES 3 and 4. It was observed that the wax composition was not viscous. However, plating in an electrodeposition bath was not observed in experimental field use.

The waxes, used in the composition set forth below, were: "Sun 5512", a paraffin wax available from Sun Chemical Company, and having a melting point of 156° F. as measured by ASTM D 87 (American Melt Point Method); the "Be Square Amber 175" previously described; "Veba-127", a series of saturated synthetic hydrocarbons of hard wax-like consistency made by a modification of the Ziegler polymerization of ethylene and having an appropriate molecular weight of 1700, commercially available from Veba-Chemie, W. Germany through its U.S. importer Dura Commodities Corp., Harrison, New York; "Zonarez 7115" having a melting point of 115° C., and "Zonarez 7070" having a melting point of 70° C., both of a series of polyterpene resins commercially available from Arizona Chemical Company, Wayne, New Jersey.

| Material | Weight Percent |
|---|---|
| Sun 5512 | 13.18 |
| Be Square Amber 175 | 3.69 |
| Veba A-217 | 1.78 |
| Zonarez 7115 | 11.10 |
| Zonarez 7070 | 5.25 |
| Glass Sphere, S-3000-S | 65.00 |

EXAMPLE 6

A further electrically conductive thermoplastic wax composition was prepared, its resistance measured and electrodeposition characteristics observed. The glass coated spheres, "S-3000-S" were added in an amount of 67.5 weight percent. The measured resistance of 0.2–0.5 ohms also correlated with highly favorable observations in the experimental field tests which showed that the composition received plating well. The waxes used in this composition, not previously described, include "HG150", a hydrofol glyceride, obtained by hydrogenation of vegetable oil and obtainable from Ashland Chemical Company. "Shanco 400", a terpene phenol resin, available from Shanco Chemical Corporation, North Tonowanda, New York. "Hercolyn D", a methyl ester of rosin stablized and deodorized by hydrogenation and steaming treatments and commercially avialable from Hercules, Inc., Pine and Paper Chemicals Department, Wilmington, Delaware.

| Material | Weight Percent | |
|---|---|---|
| Candelilla Wax | 7.83 | |
| HG 150 | 7.54 | |
| Shanco 400 | 7.83 | |
| Hercolyn D | 1.14 | |
| Be Square Amber 175 | 3.25 | (MP 175–180° F.) by ASTM, D127 |
| Be Square Amber 195 | 4.91 | (MP 193–198° F.) by ASTM, D127 |
| Glass Spheres, S-3000-S | 67.50 | |

Various of the electrically conductive thermoplastic wax compositions discussed in previous examples were also submitted for experimental field use. Thus, the compositions of EXAMPLE 1 an Sample Nos. 21, 24 and 27 of EXAMPLE 2 were observed in electrodeposition operations. However, the results were not as satisfactory as those obtained for EXAMPLES 3, 4 and 6.

Thus, those skilled in the art will recognize that virtually may thermoplastic wax material can be made electrically conductive by the incorporation of silver coated glass spheres according to this invention. However, the amount of spheres to be incorporated as well as the effect to other properties, such as flowability at forming temperatures, must be observed for each individual application and then the choice for the particular use can be made as taught herein. The conductive surface glass spheres are added in an amount sufficient to provide electrical conductivity but insufficient to prevent flowability or forming into shapes.

Electroforming is generally carried out at relatively high current densities to form hollow articles having a metal wall sufficiently thick to be self-supporting, generally being a wall thickness such as ⅛ inch or thicker. The waxes at the lower range of conductivity should prove advantageous in electroforming and in electrodischarge machining where voltages are high.

The microspheres having a size of less than 325 mesh are so fine that the conductive thermoplastic wax compositions discussed above when formed into electrodes have a desirably smooth glossy surface for providing sharp definition to the interior of the hollow electroformed articles. If desired, such glass microspheres having a thicker coating of silver, such as 8% or 12% by weight, may be used; however, those having a coating of only 4% by weight are preferred as being more economical.

The low temperature melting metal alloys discussed in the introduction as presently used in electroforming and electro discharge machining have a unit volume cost several times that obtainable with the electrically conductive thermoplastic wax composition of this invention. In addition, these alloys possess a specific gravity of approximately 10.1 which is five to six times as heavy as that of the electrically conductive thermoplastic wax compositions made according to this invention. Thus, the wax compositions have relatively low specific gravities of 0.8 to 1.6, while glass microspheres have a specific gravity of 2.45 to 2.55. The specific gravity of silver is 10.4, but when coated on the surface of the spheres in an amount of 4% by weight, the coated spheres have approximately the same specific gravity as the uncoated ones. Thus, these spherical particles are seen to have a specific gravity less than 3.2 times the wax compositions of 0.8 sp.gr. and less than 1.8 times the wax compositions of 1.6 sp.gr. The result is that the thermoplastic wax compositions discussed above, when mixed with the conductive-surface glass microspheres in an amount of 60–75 weight percent of the microspheres, have an overall specific gravity of approximately 1.5 to 2.0, and an electrode of such low sp. gr. can be made.

An example of practice of the invention in EDM will be described below. A cup-shaped metal article having an intricate external contour is to have multiple small size X-shaped apertures machined into the bottom wall of the bowl. These apertures are intended to pass completely through the bottom wall, i.e. through the outside surface of the article. The use of a low-temperature melting alloy as described in the introduction presents the problem of possible release of toxic fumes of lead, bismuth and/or antimony into the atmosphere when the powerful spark discharge punctures through the outside surface of the article in regions where this alloy would be located.

The cup-shaped article is placed on a support fixture having a generally horizontal platen with a plurality of upstanding pins upon which the article can rest. These pins temporarily initially hold the article in the desired orientation with its bowl facing upwardly. There is an encircling wall around the platen for retaining the conductive thermoplastic wax composition to be employed.

A low-resistance conductive wax composition which is not unduly viscous and which is reasonably hard and strong at room temperature for mechanically holding the article is chosen, such as Sample No. 4 from Table I in Example I. This conductive thermoplastic wax composition is heated to a temperature sufficient for flowability into intimiate contact with the intricate external configuration of the article resting on the support pins. The wax composition is maintained below an elevated temperature at which it becomes fluidized as to permit unacceptable gravity separation of the microspheres therefrom.

The heated conductive thermoplastic wax composition is flowed onto the platen for surrounding the article up to a level near to but below the lip of the bowl. Thus, the interior of the bowl does not contain any of the conductive wax composition. The conductive wax composition is cooled and hardened in surrounding relationship about the article. This hardened conductive wax composition thereby provides a low impedance electrical circuit from the article to the conductive platen for forming an overall low impedance electrode including the article. Also, the hardened wax composition now provides a relatively strong, firm mechanical support for rigidly holding the article fixed in position on the platen in readiness for the EDM operations.

The bowl is filled with a poorly conducting light oil. An electrode probe tool of appropriate configuration as known to those skilled in the EDM art for drilling such X-shaped apertures is inserted down into the light oil and is aimed at the desired local region on the bowl bottom where the first aperture is to be electric discharge machined. A high current flow spark discharging at frequent intervals between the tip of the electrode tool and the metal bowl wall removes material from the bowl wall until the aperture is completed. The procedure is repeated for EDM of the other X-shaped apertures in the bowl wall. The surrounding rigid wax composition prevents escape of the light oil through the ED machined apertures.

Then, the platen and bowl are tipped to pour out the light oil from the bowl. The conductive wax composition is heated for removal from the ED machined article. This recovered material can be reused, thereby providing economic use of materials. Any residual wax composition is removed from the intricate exterior of the article by suitable solvent for the wax composition but one which does not attach the silver-coated glass microspheres. These spherical particles are filtered or gravity separated from the solvent and are reused by mixing into another batch of the thermoplastic wax composition.

Moreover, electrodes formed of the electrically conductive thermoplastic wax compositions are recoverable after electroforming and electrodischarge machining and can be reused so that waste is reduced and resources preserved, and greater economy is achieved.

I claim:

1. In a method of forming articles by depositing metal onto the cathode of an electrodeposition circuit, the improvement which comprises forming the cathode from an electrically conductive thermoplastic wax composition including a thermoplastic wax material capable of retaining a molded shape at ambient temperature and silver coated glass microspheres, said glass microspheres being coated with at least 4% silver by weight, said silver coated glass microspheres having a size of 44 microns in diameter or less and being present in the thermoplastic wax material in an amount effective to render the wax material electrically conductive and producing a low electrical resistance wax composition.

2. The method according to claim 1, wherein the glass microspheres are present in the thermoplastic wax material in an amount of from 60 to 75% by weight.

3. The method according to claim 2, wherein the silver coated glass microspheres have a specific gravity less than 3.2 times that of the thermoplastic wax material.

4. The method according to claim 3, wherein the electrically conductive thermoplastic wax composition has a specific gravity of less than 2.0.

5. The method according to claim 3, wherein the electrically conductive thermoplastic wax composition has a specific gravity of from 1.5 to 2.0.

6. The method according to claim 3, wherein the thermoplastic wax material is essentially completely soluble in water, thereby enabling convenient and clean removal of the cathode material from the interior of the metal article deposited thereon.

7. The method according to claim 3, wherein the thermoplastic wax material is essentially completely soluble in an organic solvent, thereby enabling convenient and clean removal of the cathode material from the interior of the metal article deposited thereon.

8. The improved method as claimed in claim 1 further including recovering the wax composition for reuse as the cathode of an electrodeposition circuit.

9. The improved method as claimed in claim 1 wherein the electrically conductive thermoplastic wax composition is removed from the metal article deposited thereon by heating to melt the wax.

10. The improved method as claimed in claim 9 wherein any residual of the electrically conductive thermoplastic wax composition is removed from the metal article deposited thereon by dissolving it with a solvent for the wax composition.

* * * * *

UNITED STATES PATENT OFFICE

CERTIFICATE OF CORRECTION

Patent No. 4,098,652 Dated July 4, 1978

Inventor(s) Myron Koenig

It is certified that error appears in the above-identified patent and that said Letters Patent are hereby corrected as shown below:

Column 4, line 42, "matchining" should read -- machining -- .

Column 6, line 44, "microcyrstalline" should read -- microcrystalline -- .

Column 9, line 6, "appropriate" should read -- approximate --;

line 57, "an" before the word "Sample" should read -- and -- ;

line 63, "may" should read -- any -- ;

line 67, "to" should read -- on -- .

Column 10, line 30, "10.1" should read -- 10.5 -- .

Column 11, line 7, "intimiate" should read -- intimate --;

line 10, "becomes fluidized" should read -- becomes so fluidized -- ;

line 48, "attach" should read -- attack -- .

Signed and Sealed this

Tenth Day of June 1980

[SEAL]

Attest:

SIDNEY A. DIAMOND

Attesting Officer

Commissioner of Patents and Trademarks